US011486020B2

(12) United States Patent
Hirashima et al.

(10) Patent No.: US 11,486,020 B2
(45) Date of Patent: Nov. 1, 2022

(54) HOT-ROLLED STEEL SHEET AND PRODUCTION METHOD THEREFOR

(71) Applicant: NIPPON STEEL CORPORATION, Tokyo (JP)

(72) Inventors: Tetsuya Hirashima, Tokyo (JP); Takeshi Toyoda, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 98 days.

(21) Appl. No.: 17/048,430

(22) PCT Filed: Apr. 26, 2019

(86) PCT No.: PCT/JP2019/017932
§ 371 (c)(1),
(2) Date: Oct. 16, 2020

(87) PCT Pub. No.: WO2019/216269
PCT Pub. Date: Nov. 14, 2019

(65) Prior Publication Data

US 2021/0062289 A1 Mar. 4, 2021

(30) Foreign Application Priority Data

May 7, 2018 (JP) ..... JP2018-089179

(51) Int. Cl.

| | |
|---|---|
| ***C21D 9/46*** | (2006.01) |
| ***C21D 8/02*** | (2006.01) |
| ***C21D 6/00*** | (2006.01) |
| ***C22C 38/16*** | (2006.01) |
| ***C22C 38/14*** | (2006.01) |
| ***C22C 38/12*** | (2006.01) |
| ***C22C 38/06*** | (2006.01) |
| ***C22C 38/04*** | (2006.01) |
| ***C22C 38/02*** | (2006.01) |
| ***C22C 38/00*** | (2006.01) |
| ***C22C 38/08*** | (2006.01) |

(52) U.S. Cl.

CPC ..... *C21D 9/46* (2013.01); *C21D 6/001* (2013.01); *C21D 6/005* (2013.01); *C21D 6/008* (2013.01); *C21D 8/0205* (2013.01); *C21D 8/0226* (2013.01); *C21D 8/0236* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01)

(58) Field of Classification Search
None
See application file for complete search history.

(56) References Cited

U.S. PATENT DOCUMENTS

| | | | |
|---|---|---|---|
| 2014/0144559 | A1 | 5/2014 | Zhu et al. |
| 2015/0329950 | A1 | 11/2015 | Azuma et al. |

FOREIGN PATENT DOCUMENTS

| | | | | |
|---|---|---|---|---|
| JP | 59-229413 | A | | 12/1984 |
| JP | 10-8138 | A | | 1/1998 |
| JP | 2011-52321 | A | | 3/2011 |
| JP | 4803210 | B2 | | 10/2011 |
| JP | 2012077336 | A | * | 4/2012 |
| JP | 2014-517873 | A | | 7/2014 |
| TW | 201437388 | A | | 10/2014 |

OTHER PUBLICATIONS

"Metallic materials—Tensile testing—Method of test at room temperature", JIS Z 2241, 2011, total 37 pages.
"Method for Charpy pendulum impact test of metallic materials", JIS Z 2242, 2005, total 12 pages.

* cited by examiner

*Primary Examiner* — Anthony M Liang
(74) *Attorney, Agent, or Firm* — Birch, Stewart, Kolasch & Birch, LLP

(57) ABSTRACT

In a hot-rolled steel sheet having a predetermined chemical composition and having a metallographic structure including 90 vol % or greater of martensite and 0 vol % to 10 vol % of a residual structure, the residual structure includes one or both of bainite and ferrite, the average prior austenite grain size in an L-section parallel to a rolling direction and an average prior austenite grain size in a C-section parallel to a direction orthogonal to the rolling direction are 1.0 μm to 10.0 μm the aspect ratio associated with the prior austenite grain size is 1.8 or less, the average grain size of the residual structure in the L-section and the average grain size of the residual structure in the C-section are 5.0 μm or less, and the aspect ratio associated with the average grain size of the residual structure is 2.0 or less.

4 Claims, No Drawings

HOT-ROLLED STEEL SHEET AND PRODUCTION METHOD THEREFOR

TECHNICAL FIELD OF THE INVENTION

The present invention relates to a hot-rolled steel sheet and a manufacturing method of the hot-rolled steel sheet.

Priority is claimed on Japanese Patent Application No. 2018-089179, filed May 7, 2018, the content of which is incorporated herein by reference.

RELATED ART

In recent years, regulation of vehicle emissions has been strengthened from the viewpoint of the protection of the global environment, and improving fuel efficiency of vehicles has become an issue. Under the above circumstances, there is a demand for higher-strength and thinner steel sheets for a vehicle, and hot-rolled steel sheets having a particularly high strength have been positively applied as a material for a vehicle component. In particular, high-strength hot-rolled steel sheets having a tensile strength of 980 MPa or greater have attracted attention as a material which can dramatically improve fuel efficiency of vehicles.

As a method of increasing the mechanical properties of a steel sheet for a vehicle, it has been known that it is effective to refine crystal grains in a structure of the steel. Various researches and developments have been performed on the refining of the crystal grains.

For example, Patent Document 1 proposes a manufacturing method of an ultrafine grained ferrite steel, in which at the final stage of continuous hot rolling, reduction is applied to a steel having C: 0.4 wt % or less and total alloy element content: 5% or less at a reduction of 40% or greater and an average strain rate of 60/sec or less, and reduction is further continuously applied at a reduction of 40% or greater within 2 seconds.

Patent Document 2 discloses a manufacturing method of a fine grain hot-rolled steel sheet in which finish rolling is performed using a tandem rolling mill train after rough rolling. Patent Document 2 proposes a manufacturing method of a fine grain hot-rolled steel sheet with an average ferrite grain size of 5 μm or less, in which after rolling at a temperature of $Ar_3$ or higher by a rolling mill one stage before a final rolling mill of the tandem rolling mill train, cooling to a temperature range of "$Ar_3$− 20° C." or lower is performed at an average cooling rate of 50° C./sec or greater, rolling is performed at a reduction of 20% or less by the final rolling mill of the tandem rolling mill train, and then cooling to 720° C. is performed within 0.4 seconds.

Patent Document 3 proposes a manufacturing method of a high-tensile-strength hot-rolled steel sheet having an ultrafine structure, in which a continuous cast slab containing C: 0.05 to 0.10 wt %, Si: 0.30 to 2.0 wt %, Mn: 1.0 wt % or less, Al: 0.003 to 0.100 wt %, Ti: 0.05 to 0.30 wt % and a remainder Fe with impurities is heated to a temperature of 950° C. to 1,100° C., reduction is performed at least twice such that a reduction per pass is 20% or greater, hot rolling is performed such that a finish rolling temperature is equal to or higher than a $Ar_3$ transformation point, cooling is performed at a cooling rate of 20° C./sec or greater, and then coiling is performed in a temperature range of 350° C. to 550° C.

Patent Document 4 describes a manufacturing method of a martensite steel sheet, including a step of heating a semifinished product containing 0.15%≤C≤0.40%, 1.5%≤Mn≤3%, 0.005%≤Si≤2%, 0.005%≤Al≤0.1%, S≤0.05%, P≤0.1%, 0.025%≤Nb≤0.1%, and a remainder of the composition consisting of iron and unavoidable impurities resulting from processing to a temperature T1 between 1,050° C. and 1,250° C., a step of rolling the reheated semifinished product with a cumulative reduction ca of greater than 100% at a temperature T2 between 1,050° C. and 1,150° C. by a roughing mill to obtain a steel sheet having an incompletely recrystallized austenite structure with an average particle size of less than 40 micrometers, a step of cooling the steel sheet to a temperature T3 between 970° C. and $Ar_3$+30° C. at a rate VR1 of greater than 2° C./sec though the steel sheet is not completely cooled, a step of rolling the incompletely cooled steel sheet with a cumulative reduction εb of greater than 50% at a temperature T3 by a finish rolling mill f to obtain a steel sheet, and a step of cooling the steel sheet at a rate VR2 exceeding a critical martensite quenching rate.

In general, in a case where the strength of a material is increased, toughness deteriorates. Therefore, it is important to increase the strength without deterioration of toughness in the development of a high-strength hot-rolled steel sheet. In addition, in a case where the steel sheet is used as a member for a vehicle, it is desirable that the steel sheet is excellent in isotropy while having little anisotropy in tensile characteristics and toughness. It is also important that the load during the manufacturing of a steel sheet is small in the development of a high-strength hot-rolled steel sheet.

However, in the hot-rolled steel sheet described in Patent Document 1, rolling having large reduction is performed in order to refine the crystal grains and to improve the material characteristics, and a load on the rolling mill is large. In addition, since the structure mainly includes ferrite, the strength is not sufficient.

In the hot-rolled steel sheet described in Patent Document 2, since the crystal grains are refined by accumulating strain in the non-recrystallization region, anisotropy in tensile characteristics and toughness increases.

In the hot-rolled steel sheet described in Patent Document 3, the crystal grains are refined by lowering the slab heating temperature, but in a case where the slab heating temperature is low, solutionizing or elimination of segregation of elements does not occur, and thus anisotropy in tensile characteristics and toughness increases.

In the manufacturing method described in Patent Document 4, in the rough rolling step, recrystallization is suppressed by adding Nb or the like, and crystal grains having an average grain size of 40 μm or less are formed with the incompletely recrystallized austenite grains. That is, the roughly rolled sheet before finish rolling has a duplex grain structure including recrystallized fine crystal grains and non-recrystallized flat and coarse crystal grains having a high aspect ratio. Even in a case where such a roughly rolled sheet is subjected to finish rolling, it is not easy to obtain a hot-rolled steel sheet having an isotropic structure and characteristics.

PRIOR ART DOCUMENT

Patent Document

[Patent Document 1] Japanese Unexamined Patent Application, First Publication No. S59-229413

[Patent Document 2] Japanese Patent No. 4803210

[Patent Document 3] Japanese Unexamined Patent Application, First Publication No. H10-8138

[Patent Document 4] Published Japanese Translation No. 2014-517873 of the PCT International Publication

DISCLOSURE OF THE INVENTION

Problems to be Solved by the Invention

The present invention is contrived in view of the above circumstances, and an object thereof is to provide a hot-rolled steel sheet which is excellent in isotropy in tensile strength (ultimate tensile strength) and toughness and has a tensile strength (ultimate tensile strength) of 980 MPa or greater. Another object of the present invention is to provide a manufacturing method of a hot-rolled steel sheet which can reduce a load on a rolling mill and makes it possible to manufacture a hot-rolled steel sheet which is excellent in isotropy in tensile strength and toughness and has a tensile strength of 980 MPa or greater.

Means for Solving the Problem

In order to achieve the above-described objects, the inventors have conducted intensive studies on a method of sufficiently refining crystal grains of a hot-rolled steel sheet even in rolling under low reduction and a method of improving isotropy in tensile characteristics and toughness. As a result, it has been found that in a case where a rolling temperature, a reduction, and a cooling rate in rough rolling are optimized and the structure of a roughly rolled sheet is refined, recrystallization occurs during finish rolling even in a case where the finish rolling is performed under low reduction, a load on the rolling mill can be reduced, and a hot-rolled steel sheet having a high tensile strength and improved isotropy in tensile strength and toughness can be obtained.

In addition, by analyzing mechanical characteristics and detailed structure, it has been found that in a case where a prior austenite grain size is 1.0 μm to 10.0 μm, an aspect ratio associated therewith is 1.8 or less, a grain size of a residual structure is 5.0 μm or less, and an aspect ratio associated therewith is 2.0 or less, it is possible to obtain a high-strength hot-rolled steel sheet which has a tensile strength of 980 MPa or greater and is excellent in isotropy in tensile characteristics (particularly, tensile strength) and toughness.

The present invention has been completed through intensive studies based on the above findings. That is, the gist of the present invention is as follows.

[1] A hot-rolled steel sheet containing, as a chemical composition, by mass %: C: 0.010% to 0.200%; Si: 1.00% or less; Mn: 3.0% or less; P: 0.040% or less; S: 0.004% or less; Al: 0.10% or less; N: 0.004% or less; Nb: 0% to 0.20%; Ti: 0% to 0.15%; Mo: 0% to 1.00%; Cu:0% to 0.50%; Ni: 0% to 0.50%; and a remainder of Fe and impurities, in which a metallographic structure includes 90 vol % or greater of martensite and 0 vol % to 10 vol % of a residual structure, the residual structure includes one or both of bainite and ferrite, the average prior austenite grain size in an L-section parallel to a rolling direction and an average prior austenite grain size in a C-section parallel to a direction orthogonal to the rolling direction are 1.0 μm to 10.0 μm, the aspect ratio which is a ratio of the average prior austenite grain size in the L-section and the average prior austenite grain size in the C-section is 1.8 or less, the average grain size of the residual structure in the L-section and the average grain size of the residual structure in the C-section are 5.0 μm or less, and the aspect ratio which is the ratio of the average grain size of the residual structure in the L-section and the average grain size of the residual structure in the C-section is 2.0 or less.

[2] The hot-rolled steel sheet according to [1] may contain, as the chemical composition, by mass %, one or two or more selected from the group consisting of: Nb: 0.01% to 0.20%; Ti: 0.01% to 0.15%; Mo:0.01% to 1.00%; Cu: 0.01% to 0.50%; and Ni: 0.01% to 0.50%.

[3] A manufacturing method of a hot-rolled steel sheet including: a hot rolling process in which a steel having the chemical composition according to [1] or [2] is heated to 1,100° C. to 1,350° C., and then subjected to plural passes of reduction to perform rough rolling and finish rolling, and thus a hot-rolled steel sheet is obtained; a cooling process in which after completion of the hot rolling process, cooling is started on the hot-rolled steel sheet within 5 seconds and performed to a temperature range of 300° C. or lower at an average cooling rate of 30° C./sec or greater; and a coiling process in which the hot-rolled steel sheet after the cooling process is coiled in the temperature range of 300° C. or lower, the rough rolling is performed under the following condition (I), and the finish rolling is performed under the following condition (II).

(I) The temperature T of the steel after a final rolling pass in the rough rolling is in a range of 1,000° C. to 1,300° C., a reduction of the final rolling pass is 105−0.05×T or greater by unit %, and cooling is started within 5 seconds after the steel pass through the final rolling pass and performed to a temperature of $Ar_3$+30° C. to $Ar_3$+300° C. at an average cooling rate of 20° C./sec or greater.

(II) The temperature of the steel sheet after a final rolling pass in the finish rolling is $Ar_3$ or higher, and the reduction amount of the final pass in the finish rolling is in a range of 12% to 45%, where the $Ar_3$ is a temperature determined by the following (Formula 1).

$$Ar_3(^\circ C.)=910-310\times C-80\times Mn-20\times Cu-55\times Ni-80\times Mo \quad \text{(Formula 1)}$$

In the Formula 1, C, Mn, Cu, Ni, and Mo each represent the amount of a corresponding element by mass %, each of which is substituted by zero in a case where the corresponding element is not contained.

[4] In the manufacturing method of a hot-rolled steel sheet according to [3], by the rough rolling, a metallographic structure of the steel sheet before the finish rolling may be controlled such that an average austenite grain size in an L-section parallel to a rolling direction of the rough rolling and an average austenite grain size in a C-section parallel to a direction orthogonal to the rolling direction are 100 μm or less, and the aspect ratio which is the ratio of the average austenite grain size in the L-section and the average austenite grain size in the C-section may be 2.0 or less.

Effects of the Invention

According to the aspects of the present invention, it is possible to provide a hot-rolled steel sheet which is excellent in isotropy in tensile strength and toughness and has a tensile strength of 980 MPa or greater. According to the aspects of the present invention, it is possible to manufacture a hot-rolled steel sheet which has a high strength and is excellent in isotropy in tensile strength and toughness without an increase in load on a rolling mill. A hot-rolled steel sheet according to the present invention is suitable as a material for a structural component or a skeleton of a vehicle or a truck frame. By applying the hot-rolled steel sheet according to the present invention to a structural component of a vehicle or the like, it is possible to reduce a vehicle body weight while securing safety of the vehicle, and the environmental load can be reduced.

EMBODIMENTS OF THE INVENTION

<Hot-Rolled Steel Sheet>

A hot-rolled steel sheet according to an embodiment of the present invention (hot-rolled steel sheet according to this embodiment) is a hot-rolled steel sheet having a predetermined chemical composition and having a metallographic structure including 90 vol % or greater of martensite and 0 vol % to 10 vol % of a residual structure, in which the residual structure includes one or both of bainite and ferrite, the prior austenite grain size is 1.0 μm to 10.0 μm, the aspect ratio associated with the prior austenite grain size is 1.8 or less, the average grain size of the residual structure is 5.0 μm or less, and the aspect ratio associated with the average grain size of the residual structure is 2.0 or less.

Hereinafter, the hot-rolled steel sheet according to this embodiment will be described in detail. First, reasons for limiting the chemical composition of the hot-rolled steel sheet according to this embodiment will be described. The symbol % representing each chemical component means mass %.

[C: 0.010% to 0.200%]

C is an element necessary for solid solution strengthening and for increasing hardenability to secure the strength of a hot-rolled steel sheet by generating martensite, which is a low temperature transformation phase. In order to obtain the above effects, the C content is 0.010% or greater. Ina case where the C content is greater than 0.200%, workability and weldability deteriorate. Therefore, the C content is set within a range of 0.010% to 0.200%. The C content is more preferably set within a range of 0.040% to 0.180%.

[Si: 1.00% or Less]

In a case where the Si content is greater than 1.00%, the surface properties of a hot-rolled steel sheet significantly deteriorate, and chemical convertibility and corrosion resistance are reduced. Therefore, the Si content is 1.00% or less. The Si content is preferably 0.80% or less. Si is an element which suppresses coarse oxides and cementite which deteriorate toughness and also contributes to solid solution strengthening. Therefore, the Si content may be 0.40% or greater.

[Mn: 3.0% or Less]

In a case where the Mn content is greater than 3.0%, a band-like structure is formed due to solidifying segregation, and the anisotropy is enhanced. Whereby, workability and delayed fracture resistance properties deteriorate. Therefore, the Mn content is set within a range of 3.0% or less. The Mn content is preferably set within a range of 2.0% or less. Mn is an element which contributes to an increase in strength of a steel by being solid-solubilized and increases hardenability. In order to obtain the above effects, the Mn content may be 0.5% or greater.

[P: 0.040% or Less]

P is an element which contributes to an increase in strength of a steel by being solid-solubilized. However, it is also an element which segregates at grain boundaries, particularly prior austenite grain boundaries, and causes a reduction in low temperature toughness and workability. Therefore, the P content is preferably reduced as much as possible, but is acceptable up to 0.040%. Therefore, the P content is 0.040% or less. The P content is preferably 0.030% or less, and more preferably 0.020% or less. However, even in a case where the P content is excessively reduced, the effect meeting an increase in refining cost cannot be obtained. Therefore, the P content is preferably 0.003% or greater, and may be 0.005% or greater.

[S: 0.004% or Less]

S is an element which forms a coarse sulfide by combining with Mn and reduces the workability of a hot-rolled steel sheet. Therefore, the S content is preferably reduced as much as possible, but is acceptable up to 0.004%. Therefore, the S content is 0.004% or less. The S content is preferably 0.003% or less, and more preferably 0.002% or less. However, even in a case where the S content is excessively reduced, the effect meeting an increase in refining cost cannot be obtained. Therefore, the S content is preferably 0.0003% or greater, and may be 0.0005% or greater.

[Al: 0.10% or Less]

In a case where the Al content is excessive, oxide-based inclusions are increased. Accordingly, an excessive Al content reduces the toughness of a hot-rolled steel sheet and causes defects. Therefore, the Al content is 0.10% or less. The Al content is preferably 0.08% or less. Al is an element which acts as a deoxidizing agent and is effective in improving the cleanliness of a steel. In order to obtain the above effects, the Al content may be 0.005% or greater.

[N: 0.004% or Less]

In a case where the N content is greater than 0.004%, N which does not form a nitride exists as a solute N, and toughness is reduced. Therefore, the N content is 0.004% or less. The N content is preferably 0.003% or less. Nis an element which precipitates as a nitride by combining with a nitride-forming element and contributes to the refinement of crystal grains. In order to obtain the above effects, the N content may be 0.0005% or greater.

The above elements are base elements of the hot-rolled steel sheet according to this embodiment. However, the hot-rolled steel sheet according to this embodiment may contain one or two or more selected from the group consisting of Nb: 0.20% or less, Ti: 0.15% or less, Mo: 1.00% or less, Cu: 0.50% or less, and Ni: 0.50% or less as necessary in order to improve toughness and strength. Since these elements are not necessarily contained, the lower limit of the amount thereof is 0%. In a case where these have an effect, the amount is preferably greater than 0%.

[Nb: 0% to 0.20%]

Nb is an element which contributes to an increase in strength and fatigue strength of a hot-rolled steel sheet through the formation of a carbonitride. In order to exhibit the above effects, the Nb content is preferably greater than 0%, more preferably 0.01% or greater, and even more preferably 0.020% or greater. In a case where the Nb content is greater than 0.20%, deformation resistance is increased. Accordingly, during the manufacturing of a hot-rolled steel sheet, the rolling force of hot rolling is increased, and the burden on a rolling mill is excessively increased. These may lead to difficulties in the rolling operation. In a case where the Nb content is greater than 0.20%, coarse precipitates are formed, and thus there is a tendency that the toughness of a hot-rolled steel sheet is reduced. Therefore, the Nb content is 0.20% or less, and preferably in a range of 0.15% or less.

[Ti: 0% to 0.15%]

Ti is an element which forms a fine carbonitride and refines crystal grains, thereby improving the strength and fatigue strength of a steel sheet. In order to exhibit the above effects, the Ti content is preferably greater than 0%, more preferably 0.01% or greater. and even more preferably greater than 0.05%. In a case where the Ti content is greater than 0.15% and becomes excessive, the above-described effects are saturated, coarse precipitates are increased, and the toughness of a steel sheet is reduced. Therefore, the Ti content is 0.15% or less. The Ti content is preferably in a range of 0.10% or less.

[Mo: 0% to 1.00%]

Mo is an element which increases hardenability and contributes to high strengthen a hot-rolled steel sheet. In order to obtain the above effects, the Mo content is preferably greater than 0%. and more preferably 0.01% or greater. The alloy cost of Mo is high, and weldability deteriorates in a case where the Mo content is greater than 1.00%. Therefore, the Mo content is 1.00% or less. The Mo content is preferably in a range of 0.40% or less.

[Cu: 0% to 0.50%]

Cu is an element which contributes to an increase in strength of a steel by being solid-solubilized. Moreover, Cu increases hardenability. In order to obtain the above effects, the Cu content is preferably greater than 0%, more preferably 0.01% or greater, and even more preferably 0.05% or greater. In a case where the Cu content is greater than 0.50%, the surface properties of a hot-rolled steel sheet deteriorate. Therefore, the Cu content is 0.50% or less. The Cu content is preferably in a range of 0.30% or less.

[Ni: 0% to 0.50%]

Ni is an element which contributes to an increase in strength of a steel by being solid-solubilized and increases hardenability. In order to obtain these effects, the Ni content is preferably greater than 0%, more preferably 0.01% or greater, and even more preferably 0.02% or greater. The alloy cost of Ni is high, and weldability deteriorates in a case where the Ni content is greater than 0.50%. Therefore, the Ni content is 0.50% or less. The Ni content is preferably in a range of 0.30% or less.

Other elements may be contained within such a range that the effects of the steel sheet according to this embodiment are not impaired. For example. Ca, rare-earth metal (REM), and the like each may be contained in an amount of 0.005% or less in order to improve delayed fracture resistance properties. A trace element or the like which improves hot workability may be contained.

In the hot-rolled steel sheet according to this embodiment, the remainder other than the above components consists of Fe and impurities. Here, the impurities mean components which are mixed by various factors of the manufacturing process, including raw materials such as ores and scraps in the industrial manufacturing of a hot-rolled steel sheet, and are not intentionally added to the hot-rolled steel sheet according to this embodiment.

Next, reasons for limiting the metallographic structure (microstructure) of the hot-rolled steel sheet according to this embodiment will be described.

[Metallographic Structure Includes 90 Vol % or Greater of Martensite and 0 Vol % to 10 Vol % of Residual Structure, and Residual Structure Includes One or Both of Bainite and Ferrite]

The structure of the hot-rolled steel sheet according to this embodiment includes 90 vol % or greater of martensite and 0 vol % to 10 vol % of a residual structure. In this embodiment, the "martensite" basically means fresh martensite, but may partially include tempered martensite (for example, in a range of 10% or less). The tempered martensite is martensite which is tempered and has a lower dislocation density than martensite.

In the hot-rolled steel sheet according to this embodiment, in a case where the volume percentage of martensite is less than 90 vol %, it is difficult to obtain a desired strength. Therefore, the volume percentage of martensite is 90 vol % or greater. More preferably. the volume percentage of martensite is 95 vol % or greater.

The residual structure includes bainite and/or ferrite. The residual structure may include residual austenite. The residual structure also includes a carbide contained in bainite. In a case where the volume percentage of the residual structure is increased, the strength is reduced, and it is difficult to secure a desired high strength. Therefore, the volume percentage of the residual structure is 10 vol % or less, preferably 5 vol % or less, and more preferably 1 vol % or less. The residual structure may be 0%.

[Average Prior Austenite Grain Size is 1.0 μm to 10.0 μm, and Aspect Ratio which is Ratio Associated with Average Prior Austenite Grain Size is 1.8 or Less]

In the hot-rolled steel sheet according to this embodiment, the average prior austenite grain size (the average grain size of the prior austenite) is 1.0 μm to 10.0 μm, and the aspect ratio associated therewith is 1.8 or less.

Here, the expression of the average prior austenite grain size is 1.0 μm to 10.0 μm means that a prior austenite grain size in an L-section parallel to a rolling direction of the steel sheet and a prior austenite grain size in a C-section parallel to a direction orthogonal to the rolling direction of the steel sheet are 1.0 μm to 10.0 μm. The L-section and the C-section are in a through-thickness direction.

In a case where the average prior austenite grain size in any one of the L-section and the C-section is greater than 10.0 μm, the tensile strength is reduced, and toughness also deteriorates. Therefore, the prior austenite grain size is 10.0 μm or less. The prior austenite grain size is preferably 5.0 μm or less.

Furthermore, in a case where the average prior austenite grain size in any one of the L-section and the C-section is less than 1.0 μm, the strength increasing effect and the toughness improving effect due to the grain refinement are saturated, and martensitic transformation rarely occurs. Accordingly, 90 vol % or greater of martensite cannot be secured in the metallographic structure in some cases. Therefore, the prior austenite grain size is 1.0 μm or greater. In the manufacturing process of the hot-rolled steel sheet according to this embodiment, the austenite grain size is reduced by sufficiently recrystallizing austenite by rough rolling. However, the austenite grain size after rough rolling may be 100 μm or less, and be relatively large. Therefore, even in a case where finish rolling is performed, the austenite grain size may not be reduced to 3.0 μm or less. Therefore, practically, the prior austenite grain size of the hot-rolled steel sheet according to this embodiment may be greater than 3.0 μm, or be 3.5 μm or greater.

The expression the aspect ratio of the prior austenite is 1.8 or less means that the ratio of the average prior austenite grain size in the L-section and the average prior austenite grain size in the C-section is 1.8 or less.

The aspect ratio associated with the prior austenite grain size has an influence on anisotropy in tensile strength and toughness. In a case where the aspect ratio associated with the prior austenite grain size is greater than 1.8, the anisotropy in tensile strength and toughness is enhanced. Therefore, the aspect ratio associated with the prior austenite grain size is 1.8 or less. The aspect ratio associated with the prior austenite grain size is preferably 1.5 or less.

[Average Grain Size of Residual Structure is 5.0 μm or Less, and Aspect Ratio Associated with Average Grain Size of Residual Structure is 2.0 or Less]

The residual structure is a soft phase. Accordingly, in a case where the average grain size of the residual structure is greater than 5.0 μm, the strength of a hot-rolled steel sheet is reduced, and it is difficult to obtain a desired strength. Therefore, the average grain size is 5.0 μm or less. The lower limit of the average grain size of the residual structure is not particularly limited. However, since it is difficult to make the average grain size less than 1.0 μm from the viewpoint of the production method, the average grain size of the residual structure is practically 1.0 μm to 5.0 μm. Here, the expression the average grain size of the residual structure is 1.0 μm to 5.0 μm means that the average grain size of the residual structure in the L-section and the average grain size of the residual structure in the C-section is 1.0 μm to 5.0 μm.

In addition, the aspect ratio of the residual structure has an influence on anisotropy in tensile strength and toughness. In a case where the aspect ratio of the residual structure is greater than 2.0, the anisotropy in tensile strength and toughness is enhanced. Therefore, the aspect ratio of the residual structure is 2.0 or less. The aspect ratio is preferably 1.8 or less.

The expression the aspect ratio associated with the average grain size of the residual structure is 2.0 or less means that the ratio of the average grain size of the residual structure in the L-section and the average grain size of the residual structure in the C-section is 2.0 or less.

In the hot-rolled steel sheet according to this embodiment, the identification of each phase or structure and the calculation of the average grain size can be performed by image processing using a structure photograph taken by a scanning electron microscope (SEM) and backscattering electron diffraction image analysis (EBSP or EBSD).

More specifically, the average prior austenite grain size and the aspect ratio associated therewith are determined as follows.

In the vicinity of ¼ W (width) or ¾ W (width) from one end in a width direction of the hot-rolled steel sheet, where W is a sheet width of the hot-rolled steel sheet, a sample is collected such that sections thereof in the through-thickness direction which are parallel (L-section) and orthogonal (C-section) to the rolling direction, respectively, serve as observed sections. After being subjected to mirror polishing, the sections are corroded with a picric acid to expose the grain boundaries of the prior austenite crystal grains. Then, at a depth position of ¼ of the sheet thickness from the steel sheet surface, a region of 400 μm in the rolling direction× 400 μm in the thickness direction of the steel sheet is observed in the L-section, and a region of 400 μm in the sheet width direction×400 μm in the thickness direction of the steel sheet is observed in the C-section using a scanning electron microscope (SEM). The observation region is one continuous region.

The average prior austenite grain size is obtained by analyzing the obtained image using an image analyzer. The average austenite grain size is obtained as a circle equivalent diameter. In a case where the larger one of the average prior austenite grain size in the L-section and the average prior austenite grain size in the C-section obtained is represented by Dpγ (L) and the smaller one is represented by Dpγ (S), a value obtained by Dpγ (L)/Dpγ (S) is defined as the aspect ratio associated with the average prior austenite grain size.

The identification of the residual structure and the average grain size and the aspect ratio of the residual structure are obtained as follows.

At ¼ W (width) or ¾ W (width) from one end in a width direction of the steel sheet, where W is a sheet width of the steel sheet, a sample is collected such that sections thereof which are parallel (L-section) and orthogonal (C-section) to the rolling direction, respectively, serve as observed sections. The sections are subjected to mirror polishing, and then subjected to electrolytic polishing. Then, at a depth position of ¼ of the sheet thickness from the steel sheet surface, a region of 400 μm in the rolling direction×400 μm in the thickness direction of the steel sheet is subjected to EBSD analysis in the L-section, and a region of 400 μm in the sheet width direction×400 μm in the thickness direction of the steel sheet is subjected to EBSD analysis in the C-section, with a measurement interval of 0.1 μm. The EBSD analysis is performed at an analysis speed of 200 to 300 points/sec using, for example, a device including a thermal field emission scanning electron microscope and an EBSD detector.

Here, a crystal orientation difference between adjacent measurement points obtained based on the crystal orientation information of the measurement points measured as described above is defined as an orientation difference. In a case where the orientation difference is 15° or greater, an intermediate part between the adjacent measurement points is determined to be a grain boundary, and a region surrounded by the grain boundary is defined as crystal grains. An average orientation difference is calculated by simply averaging the orientation differences of the crystal grains within the same grain. The average orientation difference within the same grain can be calculated using software attached to an EBSD analyzer.

Grains of which the average orientation difference within the same grain is less than 0.6° are defined as ferrite. The area ratio of the grains defined as ferrite is defined as a volume percentage of ferrite.

In addition, grains of which the average orientation difference within the same grain is 0.6° or greater are defined as bainite. Martensite may have an average orientation difference of 0.6° or greater within the same grain. However, since bainite contains a carbide and has a lath-like structure, a part containing a carbide and having a lath-like structure in an SEM image is bainite, and an area ratio thereof is a volume percentage of bainite. Martensite has an average orientation difference of 0.6° or greater within the same grain, and a structure other than that determined as bainite is martensite. Since the hot-rolled steel sheet according to this embodiment is not tempered, martensite is fresh martensite containing no carbide. Even in a case where a carbide is generated in martensite, the amount thereof is very small in this embodiment, whereby martensite in which a carbide is generated in the structure may be included in the volume percentage of bainite.

That is, the volume percentage of martensite is obtained by subtracting the volume percentage of ferrite and the volume percentage of bainite from 100%.

The average grain size of the residual structure is determined using the value obtained by the EBSD analysis. Specifically, crystal grains of the residual structure are specified with a boundary having an orientation difference of 15° or greater as a grain boundary, and the value calculated by the following expression is defined as the average grain size. In the expression, N represents the number of crystal grains included in the region for evaluation of the average grain size, Ai represents an area of an i-th (i=1, 2, . . . , N) grain, and di represents a circle equivalent diameter of the i-th grain. The above data is easily obtained by EBSD analysis.

[Formula 1]

$$D = \frac{\sum_{i=1}^{N} Ai \times di}{\sum_{i=1}^{N} Ai}$$

In a case where the larger one of the average grain size of the residual structure in the L-section and the average grain size of the residual structure in the C-section obtained by the above method is represented by Dr (L) and the smaller one is represented by Dr (S), a value obtained by Dr (L)/Dr (S) is defined as the aspect ratio of the residual structure.

In the hot-rolled steel sheet according to this embodiment, a tensile strength in an L-direction parallel to the rolling direction of the steel sheet and a tensile strength in a C-direction orthogonal to the rolling direction of the steel sheet are respectively 980 MPa or greater, and an absolute value of a difference between the tensile strength in the L-direction and the tensile strength in the C-direction is less than 100 MPa.

In the hot-rolled steel sheet according to this embodiment, a ductile-brittle transition temperature in the L-direction and a ductile-brittle transition temperature in the C-direction are respectively −60° C. or lower, and an absolute value of a difference between the ductile-brittle transition temperature in the L-direction and the ductile-brittle transition temperature in the C-direction is lower than 15° C.

According to the hot-rolled steel sheet according to this embodiment, it is possible to obtain a hot-rolled steel sheet which has a high strength and is excellent in isotropy in tensile strength and toughness by satisfying the above chemical components (chemical composition) and structure. Therefore, in a case where the hot-rolled steel sheet according to this embodiment is applied to a structural component of a vehicle, this contributes to securing safety of the vehicle and improving fuel efficiency.

More preferably, the hot-rolled steel sheet according to this embodiment is excellent in product shape. Due to the excellent product shape, it is possible to manufacture a high-accuracy component in a forming process in a case where the component is formed from the steel sheet. The expression excellent in product shape means Δt/tave is less than 0.125, where tave is an average of sheet thicknesses measured at 30 points at a ratio of 1 point per 2,500 $mm^2$ of the steel sheet surface, and Δt is a difference between the maximum value and the minimum value.

<Manufacturing Method of Hot-Rolled Steel Sheet>

Next, a manufacturing method of a hot-rolled steel sheet according to this embodiment will be described.

The manufacturing method of a hot-rolled steel sheet according to this embodiment includes a hot rolling step in which a steel having the chemical components (chemical composition) described above is heated to 1,100° C. to 1,350° C., and then subjected to plural passes of reduction to perform rough rolling and finish rolling, and thus a hot-rolled steel sheet is obtained, a cooling step in which after the finish rolling, cooling is started on the hot-rolled steel sheet within 5 seconds and performed at an average cooling rate of 30° C./sec or greater. and a coiling step in which the hot-rolled steel sheet after the cooling is coiled in a temperature range of room temperature to 300° C.

The rough rolling is performed under the following condition (I), and the finish rolling is performed under the following condition (II).

(I) Rough Rolling:

In the rough rolling, a temperature T of the steel after the final rolling pass is in a range of 1,000° C. to 1,300° C., a reduction of the final rolling pass is 105-0.05×T (%) or greater (T is a temperature (° C.) of the steel after the final rough rolling pass), and cooling is started within 5 seconds after the steel pass through the final rolling pass and performed to a temperature of $Ar_3$+30° C. to $Ar_3$+300° C. at an average cooling rate of 20° C./sec or greater.

(II) Finish Rolling:

The temperature of the steel sheet after the final rolling pass in the finish rolling is $Ar_3$ or higher, and the reduction amount of the final pass in the finish rolling is in a range of 12% to 45%.

$Ar_3$ is a temperature determined by the following (Formula 1).

$$Ar_3(°\,C.)=910-310\times C-80\times Mn-20\times Cu-55\times Ni-80\times Mo \quad \text{(Formula 1)}$$

In Formula 1, C, Mn, Cu, Ni, and Mo each represent an amount (mass %) of a corresponding element, each of which is substituted by zero in a case where the corresponding element is not contained.

Hereinafter, the manufacturing method of a hot-rolled steel sheet according to this embodiment will be described in detail.

(1) Hot Rolling Step (Heating Temperature of Steel: 1,100° C. to 1,350° C.)

A heating temperature of the steel has a great influence on solutionizing or elimination of segregation of elements. In a case where the heating temperature is lower than 1,100° C., solutionizing or elimination of segregation of elements does not sufficiently occur, and anisotropy occurs in tensile strength and toughness of the product. By setting the heating temperature to 1,100° C. or higher, an element having an effect on suppressing the coarsening of austenite grains can be solutionized.

In a case where the heating temperature is higher than 1,350° C. the effect on solutionizing or elimination of segregation of elements is saturated, and the average austenite grain size coarsens. Accordingly, it is difficult to obtain a desired average austenite grain size after rough rolling. Therefore, the heating temperature of the steel is 1.100° C. to 1,350° C. The heating temperature is preferably 1,150° C. to 1,300° C.

(a) Rough Rolling Step (Temperature T of Steel after Final Rolling Pass: 1,000° C. to 1,300° C.)

In the rough rolling, the steel continuously passes through a rolling stand for rough rolling a plurality of times to perform the rolling. The rough rolling is performed such that the temperature T of the steel after the final rolling pass is 1,000° C. to 1,300° C.

In the manufacturing method of a hot-rolled steel sheet according to this embodiment, it is necessary to refine the austenite grains before the start of finish rolling by causing recrystallization during the rough rolling. In order to cause recrystallization during the rough rolling, it is desirable that the temperature of the steel during the rough rolling is high. In a case where the rough rolling temperature T of the steel is lower than 1,000° C., large reduction is required to cause recrystallization during the rough rolling, and a large load is required in the rough rolling. Therefore, the rough rolling temperature T is 1,000° C. or higher. In a case where the rough rolling temperature T is higher than 1,300° C., the grains grow before the start of finish rolling, the structure after the finish rolling coarsens, and a desired structure and characteristics cannot be obtained. The rough rolling temperature mentioned herein is the lowest temperature in the rough rolling step in which plural passes of reduction is performed, and in this embodiment, it means the temperature T of the steel immediately after the final rolling pass.

(Reduction of Final Rolling Pass is 105−0.05×T (%) or Greater)

The reduction of the final rolling pass in the rough rolling has a great influence on the grain size immediately after the completion of the rough rolling. In a case where the reduction of the final rolling pass is less than 105−0.05×T (%) (T is a temperature (° C.) of the steel after the final rough rolling pass), recrystallization cannot be sufficiently caused during the final rolling pass in the rough rolling, and thus the grain size immediately after the completion of the rough rolling coarsens. Otherwise, the structure becomes a duplex grain structure due to the recrystallization occurring only in a part of the structure. As the results, the structure after a finish rolling step to be described later also coarsens or becomes a duplex grain structure. In addition, since recrystallization does not sufficiently occur during the processing, the aspect ratio of the structure is increased, and a desired structure and characteristics cannot be thus obtained. Therefore, the reduction of the final rolling pass in the rough rolling is 105-0.05×T (%) or greater.

(Cooling at Average Cooling Rate of 20° C./Sec or Greater is Started within 5 Seconds after Final Rolling Pass)

A temperature of the steel sheet (roughly rolled sheet) at the end of the rough rolling is 1,000° C. or higher. Therefore, the grains are likely to grow. Therefore, the roughly rolled sheet is cooled to suppress the grain growth during the hot rolling step. In this case, in a case where a time from the end of rough rolling to the start of cooling is longer than 5 seconds, the structure of the roughly rolled sheet coarsens. In addition, even in a case where the time until the start of cooling is within 5 seconds, the grains significantly grow during the course of cooling, and the structure of the roughly rolled sheet coarsens in a case where the average cooling rate is less than 20° C./sec. Therefore, the time from the steel pass through the final rolling pass in the rough rolling to the start of cooling is within 5 seconds, and the average cooling rate is 20° C./sec or greater. More preferably, the cooling is started within 3 seconds, and the average cooling rate is 30° C./sec or greater.

(Cooling Stop Temperature: $Ar_3$+30° C. to $Ar_3$+300° C.)

Cooling after the end of the rough rolling is performed to a temperature range of $Ar_3$+30° C. to $Ar_3$+300° C. at the cooling start time and the cooling rate described above. In a case where a cooling stop temperature is lower than $Ar_3$+30° C., the rolling temperature may be lower than $Ar_3$ during the subsequent finish rolling step. In a case where the rolling temperature is lower than $Ar_3$, ferrite is generated during the finish rolling, and a desired structure and characteristics cannot be obtained. In a case where the cooling stop temperature is higher than $Ar_3$+300° C., the grains grow before the start of finish rolling, and the structure after the finish rolling to be described later also coarsens. Whereby, a desired structure and characteristics cannot be obtained. Therefore, the cooling after the rough rolling is performed to the temperature range of $Ar_3$+30° C. to $Ar_3$+300° C. The cooling stop temperature is preferably $Ar_3$+30° C. to $Ar_3$+100° C.

The average cooling rate is obtained by dividing a difference between a temperature of the roughly rolled sheet at the start of cooling and a temperature of the roughly rolled sheet at the end of cooling by a time required from the start of cooling to the end of cooling. The start of cooling is a time at which the injection of a cooling medium such as water to the roughly rolled sheet is started, and the end of cooling is a time at which the injection of the cooling medium is ended.

In a metallographic structure of the roughly rolled sheet before the start of finish rolling, it is preferable that an average austenite grain size is 100 μm or less and an austenite aspect ratio is 2.0 or less.

Here, the expression in which an average austenite grain size is 100 μm or less means the average austenite grain size in an L-section parallel to the rolling direction of the rough rolling and the average austenite grain size in a C-section parallel to a direction orthogonal to the rolling direction are 100 μm or less. The L-section and the C-section are in a through-thickness direction.

The expression in which an austenite aspect ratio is 2.0 or less means that the ratio of the average austenite grain size in the L-section and an average austenite grain size in the C-section (the larger value/the smaller value) is 2.0 or less.

The smaller the austenite grain size before the start of finish rolling, the lower the reduction required to cause recrystallization in the finish rolling. In a case where the average austenite grain size before the start of finish rolling is greater than 100 μm. the reduction required to cause recrystallization during the finish rolling is increased, a load on the rolling mill is increased, and the product shape deteriorates in some cases. Therefore, the average austenite grain size before the start of finish rolling is preferably 100 μm or less. The average austenite grain size is more preferably 50 μm or less, and even more preferably 30 μm or less.

The aspect ratio associated with the austenite grain size before the finish rolling has a great influence on the aspect ratio of the structure after the finish rolling. In a case where the aspect ratio of the austenite before the finish rolling is greater than 2.0, the prior austenite grain size of the structure after the finish rolling and the aspect ratio of the residual structure each may not satisfy a predetermined value, and the isotropy in tensile strength and toughness may be impaired. Therefore, the aspect ratio associated with the austenite grain size before the finish rolling is preferably 2.0 or less. The aspect ratio is more preferably 1.5 or less.

In order to confirm the average grain size and the aspect ratio of the austenite of the roughly rolled sheet, the roughly rolled sheet before finish rolling is cooled as fast as possible, preferably to room temperature at a cooling rate of 20° C./sec or greater, and the structure of a section of the roughly rolled sheet is etched to expose austenite grain boundaries and is observed with a scanning electron microscope.

More specifically, at ¼ W (width) or ¾ W (width) from one end in a width direction of the roughly rolled sheet after the rapid cooling, where W is a sheet width of the roughly rolled sheet, a sample is collected such that sections thereof which are parallel (L-section) and orthogonal (C-section) to the rolling direction, respectively, serve as observed sections. The sections are subjected to mirror polishing, and then corroded with a picric acid to expose the grain boundaries of the austenite crystal grains. Then, at a depth position of ¼ of the sheet thickness from the surface of the roughly rolled sheet, a region of 200 μm in the rolling direction×200 μm in the thickness direction of the roughly rolled sheet is observed in the L-section, and a region of 200 μm in the sheet width direction×200 μm in the thickness direction of the roughly rolled sheet is observed in the C-section, using a scanning electron microscope (SEM). The average austenite grain size is obtained by analyzing the obtained image using an image analyzer. The average austenite grain size is obtained as a circle equivalent diameter. In a case where the larger one of the average austenite grain size in the L-section and the average austenite grain size in the C-section obtained is represented by Dpγ (L) and the smaller one is represented by Dpγ (S), a value obtained by Dpγ (LyDpγ (S) is defined as the aspect ratio associated with the austenite grain size.

(b) Finish Rolling Step

In the finish rolling step, the steel continuously passes through a rolling stand for finish rolling a plurality of times to perform the (plural passes of) rolling. In this case, the temperature of the steel sheet after the final rolling pass in the finish rolling is $Ar_3$ or higher, and a reduction amount of the final pass in the finish rolling is in a range of 12% to 45%.

(Temperature of Steel Sheet after Final Rolling Pass: $Ar_3$ or Higher)

In a case where the temperature is lower than $Ar_3$ in the finish rolling, ferrite is generated during the finish rolling. Therefore, it is not possible to obtain a desired structure and characteristics. Therefore, the temperature in the finish rolling is $Ar_3$ or higher. The temperature in the finish rolling mentioned herein is the lowest temperature in the finish rolling step having a plurality of stands, and in this embodiment, a temperature of the steel sheet immediately after the final rolling pass is used.

(Reduction Amount of Final Pass is 12% to 45%)

In the manufacturing method of a hot-rolled steel sheet according to this embodiment, austenite is refined in the rough rolling. Therefore, it is possible to obtain a steel sheet having excellent isotropy in tensile strength and toughness without an increase in reduction amount in the finish rolling. However, in a case where the reduction amount of the final pass is less than 12%, recrystallization does not occur in the finish rolling, the isotropy of the structure cannot be secured, and desired characteristics cannot be obtained. In addition, in a case where the reduction amount of the final pass is greater than 45%, a load on the rolling stand is increased. Furthermore, the shape of the hot-rolled steel sheet after the finish rolling may deteriorate. Therefore, the reduction amount of the final pass in the finish rolling is preferably in a range of 12% to 45%, and more preferably in a range of 15% to 45%.

(c) Cooling Step in which after Finish Rolling, Cooling is Started within 5 Seconds and Performed at Average Cooling Rate of 30° C./Sec or Greater Immediately after the finish rolling, cooling is started. In a case where a time required from the end of finish rolling to the start of cooling is longer than 5 seconds, the structure after the finish rolling coarsens. In addition, even in a case where the time until the start of cooling is within 5 seconds, ferrite and bainite are likely to be generated during the cooling, and a desired structure and characteristics cannot be obtained in a case where the average cooling rate is less than 30° C./sec. Therefore, the time from when the finish rolling is ended to when the cooling is started is within 5 seconds, and the average cooling rate is 30° C./sec or greater. Preferably, the cooling is started within 3 seconds and is performed at an average cooling rate of 50° C./sec or greater. The end of finish rolling is a time at which the steel sheet passes the final rolling pass in the finish rolling, and the start of cooling is a time at which the injection of a cooling medium to the steel sheet is started as will be described later.

In the manufacturing method of a hot-rolled steel sheet according to this embodiment, the prior austenite grains after the rough rolling are prior austenite grains which do not coarsen, that is, austenite grains in which the fine grain region is not absorbed by coarse grains with the Ostwald growth, and they are prior austenite in which the fine grain region is mixed. Therefore, the prior austenite grains after the finish rolling inherit the characteristics of the austenite grains after the rough rolling, and the grain boundaries are stabilized even with the fine grain region mixed. Therefore, even in a case where the cooling is started within 5 seconds after the finish rolling, the fine grain region is not absorbed by coarse grains, and the ductile-brittle transition temperature thereafter rises. The fine grain region is a region in which the area ratio of a part of which the prior austenite grain size is 20% or less of the average grain size is 30% or less.

In this embodiment, cooling equipment is installed at a rear stage of the finish rolling equipment, and the cooling is performed while the steel sheet after the finish rolling passes through the cooling equipment. The cooling equipment is preferably capable of cooling the steel sheet at a cooling rate of 30° C./sec or greater. Examples of the cooling equipment include water cooling equipment using water as a cooling medium.

The average cooling rate is a value obtained by dividing a temperature drop width of the steel sheet from when the cooling is started to when the cooling is ended by a time required from when the cooling is started to when the cooling is ended. The start of cooling refers to a time when the injection of a cooling medium to the steel sheet by the cooling equipment is started, and the end of cooling refers to a time when the steel sheet is ejected from the cooling equipment.

Examples of the cooling equipment include equipment having no air cooling section and equipment having at least one air cooling section. In this embodiment, any cooling equipment may be used. Even in a case where cooling equipment having an air cooling section is used, the average cooling rate from the start of cooling to the end of cooling may be 30° C./sec or greater.

(d) Coiling Step of Coiling Steel Sheet in Temperature Range of 300° C. or Lower The steel sheet cooled to the cooling stop temperature in the cooling step is coiled in a temperature range of room temperature to 300° C. in the coiling step. Since the steel sheet is coiled immediately after the cooling step, the coiling temperature is almost equal to the cooling stop temperature. In a case where the coiling temperature is higher than 300° C., a large amount of polygonal ferrite or bainite is generated, and thus a desired structure and characteristics cannot be obtained. Therefore, the coiling temperature, which is the cooling stop temperature, is 300° C. or lower. The expression room temperature or higher means 20° C. or higher.

After the coiling, the hot-rolled steel sheet may be subjected to temper rolling according to a conventional method. or subjected to pickling to remove the scale formed on the surface. Otherwise, coating such as hot dip galvanizing or electrogalvanizing, or a chemical conversion treatment may be performed.

By casting a steel having the same composition as that described for the hot-rolled steel sheet according to this embodiment, and by then subjecting the steel to rough rolling, finish rolling, and subsequent cooling and coiling as described above, it is possible to manufacture a hot-rolled steel sheet having a metallographic structure including 90 vol % or greater of martensite and 0 vol % to 10 vol % of a residual structure, in which the residual structure includes one or both of bainite and ferrite, a prior austenite grain size is 1.0 μm to 10.0 μm, the aspect ratio associated with the prior austenite grain size is 1.8 or less, the average grain size of the residual structure is 5.0 μm or less, and the aspect ratio associated with the average grain size of the residual structure is 2.0 or less. Thus, according to the manufacturing method described above, it is possible to manufacture a hot-rolled steel sheet which has a high strength and is excellent in isotropy in tensile strength and toughness without an increase in load on a rolling mill.

EXAMPLES

Hereinafter, the present invention will be described in greater detail with examples, but is not limited to these examples.

Molten steels having chemical components shown in Table 1 were melted in a converter and made into slabs (steels) by a continuous casting method, respectively. Next, the steels were made into hot-rolled steel sheets having a sheet thickness of 3.0 mm by hot rolling, cooling, and coiling conditions shown in Table 2. $Ar_3$ (° C.) in Tables 1 and 2 was calculated by the following formula.

$$Ar_3(°\,C.)=910-310\times C-80\times Mn-20\times Cu-55\times Ni-80\times Mo \quad \text{(Formula 1)}$$

In Formula 1. C, Mn, Cu, Ni, and Mo each represent the amount (mass %) of a corresponding element, each of which is substituted by zero in a case where the corresponding element is not contained.

TABLE 1

| Steel | Chemical Components (mass %) Remainder: Fe and Impurities | | | | | | | | | | | | $Ar_3$ |
|---|---|---|---|---|---|---|---|---|---|---|---|---|---|
| No. | C | Si | Mn | P | S | Al | N | Ti | Nb | Mo | Cu | Ni | ° C. |
| A | 0.050 | 0.06 | 2.0 | 0.002 | 0.002 | 0.03 | 0.004 | | | | | | 735 |
| B | 0.070 | 0.08 | 2.1 | 0.003 | 0.002 | 0.03 | 0.004 | 0.11 | | | | | 720 |
| C | 0.100 | 0.10 | 1.5 | 0.003 | 0.002 | 0.02 | 0.003 | | 0.02 | | | | 759 |
| D | 0.080 | 0.60 | 2.1 | 0.002 | 0.001 | 0.07 | 0.004 | 0.12 | 0.02 | | | | 717 |
| E | 0.100 | 0.20 | 2.8 | 0.010 | 0.003 | 0.07 | 0.004 | 0.10 | | 0.03 | | | 653 |
| F | 0.150 | 0.70 | 1.4 | 0.022 | 0.004 | 0.06 | 0.003 | | | | 0.20 | 0.40 | 726 |
| G | 0.110 | 0.03 | 1.6 | 0.007 | 0.003 | 0.09 | 0.003 | | | 0.20 | | 0.02 | 731 |
| H | 0.008 | 0.60 | 1.4 | 0.003 | 0.004 | 0.05 | 0.004 | 0.04 | 0.03 | | | | 796 |
| I | 0.110 | 0.90 | 3.3 | 0.010 | 0.003 | 0.04 | 0.004 | | | | | | 612 |

The underline represents that the underlined value is out of the scope of the present invention.

The blank represents that the corresponding element is not positively contained.

TABLE 2

| | | | Rough Rolling | | | | | | | | |
|---|---|---|---|---|---|---|---|---|---|---|---|
| Test No. | Components of Steel | Heating Temperature ° C. | Final Pass Temperature (T) ° C. | 105-0.05 T % | Reduction Amount of Final Pass % | Time Until Start of Cooling sec | Cooling Rate ° C./sec | $Ar_3$ ° C. | $Ar_3$ + 30 ° C. | $Ar_3$ + 300 ° C. | Cooling Stop Temperature ° C. |
| 1 | A | 1250 | 1173 | 46 | 55 | 2 | 37 | 735 | 765 | 1035 | 914 |
| 2 | A | 1250 | 1192 | 45 | 55 | 1 | 26 | 735 | 765 | 1035 | 999 |
| 3 | A | 1200 | 1113 | 49 | 55 | 5 | 38 | 735 | 765 | 1035 | 1020 |
| 4 | A | 1300 | 1184 | 46 | 55 | 9 | 29 | 735 | 765 | 1035 | 849 |
| 5 | A | 1150 | 1089 | 51 | 55 | 4 | 20 | 735 | 765 | 1035 | 990 |
| 6 | B | 1150 | 1016 | 54 | 50 | 2 | 29 | 720 | 750 | 1020 | 894 |
| 7 | B | 1200 | 1110 | 50 | 50 | 2 | 35 | 720 | 750 | 1020 | 826 |
| 8 | B | 1250 | 1110 | 50 | 50 | 1 | 38 | 720 | 750 | 1020 | 915 |
| 9 | B | 1300 | 1167 | 47 | 50 | 1 | 29 | 720 | 750 | 1020 | 979 |
| 10 | B | 1200 | 1056 | 52 | 55 | 5 | 39 | 720 | 750 | 1020 | 928 |
| 11 | C | 1250 | 1132 | 48 | 55 | 4 | 44 | 759 | 789 | 1059 | 889 |
| 12 | C | 1250 | 1159 | 47 | 55 | 1 | 46 | 759 | 789 | 1059 | 901 |
| 13 | C | 1250 | 1195 | 45 | 55 | 1 | 47 | 759 | 789 | 1059 | 943 |
| 14 | C | 1250 | 1159 | 47 | 50 | 2 | 21 | 759 | 789 | 1059 | 1017 |
| 15 | C | 1200 | 1186 | 46 | 50 | 5 | 23 | 759 | 789 | 1059 | 895 |
| 16 | D | 1300 | 1095 | 50 | 55 | 1 | 29 | 717 | 747 | 1017 | 995 |
| 17 | D | 1300 | 1125 | 49 | 55 | 3 | 40 | 717 | 747 | 1017 | 990 |
| 18 | D | 1250 | 1199 | 45 | 50 | 2 | 35 | 717 | 747 | 1017 | 942 |
| 19 | E | 1300 | 1192 | 45 | 50 | 4 | 35 | 653 | 683 | 953 | 711 |
| 20 | E | 1200 | 1142 | 48 | 50 | 3 | 20 | 653 | 683 | 953 | 801 |
| 21 | E | 1200 | 1095 | 50 | 50 | 5 | 44 | 653 | 683 | 953 | 808 |
| 22 | F | 1250 | 1155 | 47 | 50 | 5 | 34 | 726 | 756 | 1026 | 875 |
| 23 | F | 1250 | 1100 | 50 | 55 | 4 | 42 | 726 | 756 | 1026 | 827 |
| 24 | F | 1250 | 1096 | 50 | 55 | 1 | 28 | 726 | 756 | 1026 | 832 |
| 25 | G | 1150 | 1182 | 46 | 55 | 3 | 25 | 731 | 761 | 1031 | 1097 |
| 26 | G | 1250 | 1145 | 48 | 55 | 2 | 49 | 731 | 761 | 1031 | 955 |
| 27 | G | 1250 | 1032 | 53 | 55 | 1 | 47 | 731 | 761 | 1031 | 889 |
| 28 | G | 1300 | 1200 | 45 | 55 | 2 | 10 | 731 | 761 | 1031 | 959 |
| 29 | H | 1200 | 1166 | 47 | 50 | 4 | 43 | 796 | 826 | 1096 | 998 |
| 30 | I | 1250 | 1200 | 45 | 50 | 1 | 24 | 612 | 642 | 912 | 910 |
| 31 | A | 1200 | 1100 | 50 | 40 | — | — | 735 | 765 | 1035 | 1000 |
| 32 | A | 1250 | 1200 | 45 | 50 | — | — | 735 | 765 | 1035 | 950 |
| 33 | A | 1050 | 1000 | 55 | 55 | 4 | 40 | 735 | 765 | 1035 | 900 |
| 34 | A | 1200 | 1100 | 50 | 40 | — | — | 735 | 765 | 1035 | 1000 |

TABLE 2-continued

| | Finish Rolling | | | | | |
|---|---|---|---|---|---|---|
| Test No. | Reduction Amount of Final Pass % | Final Rolling Temperature ° C. | Time Until Start of Cooling sec | Cooling Rate ° C./sec | Cooling Stop Temperature (coiling temperature) ° C. | Remarks |
| 1 | 13 | 888 | 4 | 192 | 234 | Example |
| 2 | 16 | 976 | 2 | 83 | 107 | Example |
| 3 | 28 | 997 | 1 | 60 | 245 | Example |
| 4 | 22 | 828 | 1 | 110 | 119 | Comparative Example |
| 5 | 38 | 962 | 3 | 52 | 150 | Example |
| 6 | 26 | 875 | 1 | 199 | 253 | Comparative Example |
| 7 | 11 | 778 | 4 | 25 | 43 | Comparative Example |
| 8 | 21 | 887 | 8 | 147 | 34 | Comparative Example |
| 9 | 19 | 945 | 3 | 96 | 108 | Example |
| 10 | 16 | 880 | 3 | 113 | 198 | Example |
| 11 | 10 | 846 | 5 | 93 | 115 | Comparative Example |
| 12 | 14 | 864 | 4 | 194 | 118 | Example |
| 13 | 26 | 926 | 2 | 124 | 161 | Example |
| 14 | 17 | 984 | 4 | 49 | 341 | Comparative Example |
| 15 | 36 | 871 | 1 | 34 | 289 | Example |
| 16 | 21 | 949 | 2 | 153 | 33 | Example |
| 17 | 33 | 980 | 4 | 77 | 131 | Example |
| 18 | 23 | 929 | 1 | 197 | 174 | Example |
| 19 | 17 | 640 | 3 | 156 | 259 | Comparative Example |
| 20 | 27 | 778 | 3 | 174 | 267 | Example |
| 21 | 32 | 770 | 4 | 53 | 47 | Example |
| 22 | 38 | 856 | 3 | 95 | 219 | Example |
| 23 | 13 | 791 | 2 | 100 | 33 | Example |
| 24 | 21 | 783 | 3 | 65 | 116 | Example |
| 25 | 14 | 1066 | 4 | 106 | 124 | Comparative Example |
| 26 | 29 | 911 | 4 | 102 | 98 | Example |
| 27 | 33 | 869 | 1 | 77 | 84 | Example |
| 28 | 42 | 939 | 3 | 143 | 190 | Comparative Example |
| 29 | 48 | 978 | 3 | 175 | 74 | Comparative Example |
| 30 | 30 | 887 | 3 | 78 | 171 | Comparative Example |
| 31 | 25 | 900 | 1 | 50 | 150 | Comparative Example |
| 32 | 20 | 900 | 3 | 100 | 200 | Comparative Example |
| 33 | 24 | 870 | 0.3 | 40 | 250 | Comparative Example |
| 34 | 25 | 900 | 1 | 50 | 450 | Comparative Example |

The underline represents that the underlined value is out of the scope of the present invention.

The "heating temperature" in Table 2 is a heating temperature of the slab. The final pass temperature in the rough rolling is a temperature of the steel sheet immediately after the steel sheet passes the final pass of the rolling mill in the rough rolling. The time until the start of cooling is a time from after the final pass in the rough rolling to the start of the injection of a cooling medium. The cooling rate during cooling is represented by an average rate obtained by dividing a temperature drop width of the steel sheet from when the steel sheet is introduced into cooling equipment (when cooling water is applied) to when the steel sheet is ejected from the water cooling equipment by a time required for the steel sheet to pass through the water cooling equipment. The cooling stop temperature is the temperature after the steel sheet is ejected from the water cooling equipment.

The final rolling temperature in the finish rolling is a temperature of the steel sheet immediately after the steel sheet passes the final pass of the rolling mill in the finish rolling. The time until the start of cooling is a time from when the steel sheet passes the final pass in the finish rolling to when the injection of a cooling medium is started. The cooling rate during cooling is represented by an average rate obtained by dividing a temperature drop width of the steel sheet from when the steel sheet is introduced into water cooling equipment (when cooling water is applied) to when the steel sheet is ejected from the water cooling equipment by a time required for the steel sheet to pass through the water cooling equipment.

A test piece was collected from the obtained hot-rolled steel sheet, and structure observation (scanning electron microscope and EBSD), a tensile test, and a Charpy test were performed thereon. The structure observation was performed at an analysis speed of 200 to 300 points/sec using a device including a thermal field emission scanning electron microscope (JSM-7001F manufactured by JEOL Ltd.) and an EBSD detector (HIKARI detector manufactured by TSL). The average orientation difference within the same grain was calculated using software (OIM Analysis™) attached to the EBSD analyzer.

In the tensile test, a JIS No. 5 test piece was collected from the hot-rolled steel sheet such that a tensile direction was parallel (L-direction) and orthogonal (C-section) to the rolling direction to perform the tensile test based on the provisions of JIS Z 2241:2011, and a tensile strength (TS) was obtained. In the present invention, the expression excellent in isotropy in tensile strength means that a value obtained by |TS (L)−TS (C)|, where TS (L) is a tensile strength in the L-direction and TS (C) is a tensile strength in the C-direction is less than 100 MPa. Accordingly, in a case where the tensile strengths in the L-direction and in the C-direction were 980 MPa or greater, and |TS (L)−TS (C)| was less than 100 MPa, it was judged that the steel sheet had a high strength and was excellent in isotropy in tensile strength.

In the Charpy test, a sub-size test piece (V-notch) having a thickness of 2.5 mm was collected from the hot-rolled steel sheet such that a longitudinal direction of the test piece was parallel (L-direction) and orthogonal (C-section) to the rolling direction to perform the Charpy impact test at a temperature of room temperature to −198° C. based on the provisions of JIS Z 2242:2005, and a ductile-brittle transition temperature was obtained to evaluate toughness. Here, the test piece was prepared so as to have a sheet thickness of 2.5 mm by subjecting the hot-rolled steel sheet to double-side grinding. In the present invention, the expression excellent toughness means that the ductile-brittle transition temperature is −60° C. or lower, and the expression excellent in isotropy in toughness means that a value obtained by |vTrs (L) −vTrs (C)|, where vTrs (L) is a ductile-brittle transition temperature in the L-direction and vTrs(C) is a ductile-brittle transition temperature in the C-direction, obtained by the Charpy test, is less than 15° C. Accordingly, in a case where the ductile-brittle transition temperatures in the L-direction and in the C-direction were −60° C. or lower, and |vTrs (L) −vTrs (C)| was less than 15° C., it was judged that the steel sheet had excellent toughness and was excellent in isotropy in toughness.

The shape evaluation was performed with a value calculated by Δt/tave, where tave was defined as an average of sheet thicknesses, and Δt was defined as a difference between the maximum value and the minimum value, when the sheet thickness was measured at 30 points at a ratio of 1 point per 2,500 $mm^2$ of the steel sheet surface. The shape was evaluated to be excellent in a case where Δt/tave was less than 0.125. However, in a case where the tensile strength and its isotropy and the ductile-brittle transition temperature and its isotropy are at acceptable levels, the object of the steel sheet according to this embodiment can be achieved even in a case where Δt/tave is less than 0.125.

The hot-rolled steel sheets of the examples have a desired tensile strength (TS: 980 MPa or greater in both the L-direction and the C-direction) and desired toughness (−60° C. or less in both the L-direction and the C-direction) with regard to both the tensile strength and the toughness in the L-direction and the C-direction. In addition, the hot-rolled steel sheets of the examples are excellent in isotropy in tensile strength and toughness (ITS (L) −TS (C)| is less than 100 MPa, and |vTrs (L) −vTrs (C)| is less than 15° C.). Furthermore, some hot-rolled steel sheets had an excellent product shape. A hot-rolled steel sheet including a residual structure included one or both of ferrite and bainite as the residual structure.

In contrast, the hot-rolled steel sheets of the comparative examples, which are out of the scope of the present invention, cannot secure a desired strength and desired toughness, or isotropy thereof. The residual structure thereof included one or both of ferrite and bainite.

In No. 4. since the time from the completion of rough rolling to the start of cooling was long, the grains grew, and the austenite grain size before the finish rolling coarsened. Therefore, it was not possible to cause recrystallization during the finish rolling, and the prior austenite grain size was not sufficiently refined. In addition, since the aspect ratio associated with the austenite grain size before the finish rolling deteriorated, the aspect ratio of the prior austenite grains in the structure after the finish rolling also deteriorated. As a result, the tensile strength, toughness, and isotropy thereof deteriorated.

In No. 6, the reduction amount of the final pass in the rough rolling was small, and recrystallization did not occur during the rough rolling. Accordingly, the austenite grain size before the finish rolling coarsened, and it was not possible to cause recrystallization during the finish rolling. In addition, since the prior austenite grain size was not sufficiently refined and the residual structure also coarsened, the tensile strength in the L-direction deteriorated, and the toughness in the L-direction and in the C-direction deteriorated. In addition, since the aspect ratio associated with the austenite grain size before the finish rolling deteriorated, the aspect ratio of the prior austenite grains in the structure after the finish rolling also deteriorated. As a result, isotropy in tensile strength and toughness deteriorated.

In No. 7, the cooling rate after the finish rolling was low, ferrite was generated during the cooling, and the ferrite grain size coarsened. As a result, the tensile strength in the L-direction and in the C-direction deteriorated.

In No. 8, since the time from after the finish rolling to the start of cooling was long and the grains grew after the finish rolling, the prior austenite grains coarsened. As a result, the toughness in the L-direction and in the C-direction deteriorated.

In No. 11, the reduction amount of the final pass in the finish rolling was small. Therefore, recrystallization did not sufficiently proceed in the finish rolling, and the aspect ratio of the prior austenite grains after the finish rolling also deteriorated. As a result, anisotropy occurred in toughness.

In No. 14. the cooling stop temperature (coiling temperature) after the finish rolling was high, bainite was generated, and the bainite grain size coarsened. As a result, the tensile strength in the L-direction deteriorated.

In No. 19, the rolling temperature in the finish rolling was low, and ferrite was generated during the rolling. Accordingly, the tensile strength in the L-direction and in the C-direction deteriorated. In addition, the aspect ratio of ferrite (residual structure) deteriorated. As a result, the isotropy in toughness deteriorated.

In No. 25, since the cooling stop temperature after the rough rolling was high, the grains grew, and the austenite grain size before the finish rolling coarsened. Accordingly, it was not possible to cause recrystallization during the finish rolling, and the prior austenite grain size was not sufficiently refined. As a result, the tensile strength in the L-direction deteriorated. The toughness in the L-direction and in the C-direction also deteriorated. In addition, since the aspect ratio associated with the austenite grain size before the finish rolling deteriorated, the aspect ratio of the prior austenite grains in the structure after the finish rolling also deteriorated. As a result, the isotropy in tensile strength and toughness deteriorated.

In No. 28, since the cooling rate after the rough rolling was low, the grains grew, and the austenite grain size before the finish rolling coarsened. Accordingly, it was not possible to cause recrystallization during the finish rolling, and thus the prior austenite grain size was not sufficiently refined. As a result, the tensile strength and the toughness in the L-direction and in the C-direction deteriorated.

In No. 29. the C content was low, and it was not possible to sufficiently generate martensite. As a result, the tensile strength in the L-direction and in the C-direction deteriorated. In addition, since the reduction amount of the final pass in the finish rolling was large, the shape was inferior.

In No. 30, the rough rolling conditions and the finish rolling conditions were satisfied. However, since the Mn content was large and a band-like structure was formed, anisotropy occurred in tensile strength and toughness, and the toughness in the L-direction deteriorated.

In No. 31, the reduction amount of the final pass in the rough rolling was small. and recrystallization did not occur during the rough rolling. In addition, since cooling was not performed after the rough rolling, the austenite grain size before the finish rolling coarsened. Therefore, the prior austenite grain size after the finish rolling coarsened, and the aspect ratio also deteriorated. As a result, toughness deteriorated, and isotropy in toughness and tensile strength also deteriorated.

In No. 32, since cooling was not performed after the rough rolling, the austenite grain size before the finish rolling coarsened. Therefore, the prior austenite grain size after the finish rolling coarsened. As a result, toughness deteriorated, and isotropy in toughness and tensile strength also deteriorated.

In No. 33, since the slab heating temperature was low, solutionizing or elimination of segregation of elements did not sufficiently occur, and thus segregation remained, and the aspect ratio associated with the austenite grain size after the rough rolling coarsened. As a result, anisotropy occurred in tensile strength and toughness.

In No. 34, the reduction amount of the final pass in the rough rolling was small, and recrystallization did not occur during the rough rolling. In addition, since cooling was not performed after the rough rolling, the austenite grain size before the finish rolling coarsened. Therefore, the prior austenite grain size after the finish rolling coarsened, and the aspect ratio also deteriorated. In addition, since the coiling temperature was high, the volume percentage of martensite was lowered. As a result, the tensile strength in the L-direction and in the C-direction deteriorated.

TABLE 3

| | | | | | Structure After Finish Rolling | | | | | | | |
|---|---|---|---|---|---|---|---|---|---|---|---|---|
| | | Structure Before Finish Rolling Grain Size of γ | | | M Phase Volume | Prior γ Grain Size of Prior γ | | | Residual Structure Volume | Residual Structure Average Grain Size | | |
| Test No. | Components of Steel | L μm | C μm | Aspect Ratio | Percentage % | L μm | C μm | Aspect Ratio | Percentage % | L μm | C μm | Aspect Ratio |
| 1 | A | 44 | 37 | 1.2 | 90 | 7.4 | 5.0 | 1.5 | 10 | 3.5 | 2.7 | 1.3 |
| 2 | A | 33 | 21 | 1.6 | 92 | 7.5 | 6.8 | 1.1 | 8 | 4.5 | 2.6 | 1.7 |
| 3 | A | 49 | 73 | 1.5 | 95 | 8.1 | 6.6 | 1.2 | 5 | 3.3 | 2.3 | 1.4 |
| 4 | A | 134 | 55 | 2.4 | 91 | 36.0 | 17.0 | 2.1 | 9 | 4.2 | 2.5 | 1.7 |
| 5 | A | 79 | 65 | 1.2 | 91 | 9.0 | 9.9 | 1.1 | 9 | 4.3 | 3.3 | 1.3 |
| 6 | B | 154 | 58 | 2.7 | 94 | 22.0 | 10.0 | 2.2 | 6 | 8.4 | 5.4 | 1.6 |
| 7 | B | 38 | 59 | 1.6 | 71 | 10.0 | 7.4 | 1.4 | 29 | 15.0 | 8.9 | 1.7 |
| 8 | B | 77 | 70 | 1.1 | 96 | 15.0 | 15.0 | 1.0 | 4 | 4.0 | 2.3 | 1.7 |
| 9 | B | 16 | 22 | 1.4 | 100 | 4.1 | 7.1 | 1.7 | 0 | 3.0 | 1.9 | 1.6 |
| 10 | B | 28 | 50 | 1.8 | 96 | 4.8 | 3.1 | 1.5 | 4 | 2.3 | 4.4 | 1.9 |
| 11 | C | 23 | 20 | 1.2 | 91 | 13.0 | 5.5 | 2.4 | 9 | 6.1 | 3.1 | 2.0 |
| 12 | C | 57 | 67 | 1.2 | 99 | 2.1 | 3.7 | 1.8 | 1 | 2.2 | 1.1 | 2.0 |
| 13 | C | 60 | 59 | 1.0 | 96 | 8.8 | 7.1 | 1.2 | 4 | 3.7 | 2.1 | 1.8 |
| 14 | C | 37 | 68 | 1.8 | 75 | 1.9 | 2.5 | 1.3 | 25 | 8.9 | 5.1 | 1.7 |
| 15 | C | 44 | 66 | 1.5 | 95 | 4.7 | 5.7 | 1.2 | 5 | 4.9 | 2.9 | 1.7 |
| 16 | D | 66 | 44 | 1.5 | 99 | 10.0 | 9.4 | 1.1 | 1 | 2.4 | 2.5 | 1.0 |
| 17 | D | 28 | 37 | 1.3 | 100 | 1.3 | 1.7 | 1.3 | 0 | 3.3 | 4.6 | 1.4 |
| 18 | D | 34 | 26 | 1.3 | 91 | 9.1 | 8.1 | 1.1 | 9 | 4.6 | 2.7 | 1.7 |
| 19 | E | 30 | 47 | 1.6 | 59 | 5.2 | 4.0 | 1.3 | 41 | 4.7 | 1.2 | 3.9 |
| 20 | E | 49 | 77 | 1.6 | 96 | 8.8 | 6.8 | 1.3 | 4 | 3.9 | 4.2 | 1.1 |
| 21 | E | 69 | 45 | 1.5 | 97 | 7.1 | 5.4 | 1.3 | 3 | 3.9 | 3.5 | 1.1 |
| 22 | F | 20 | 34 | 1.7 | 95 | 8.5 | 8.0 | 1.1 | 5 | 3.5 | 3.2 | 1.1 |
| 23 | F | 60 | 48 | 1.3 | 90 | 4.1 | 6.7 | 1.6 | 10 | 2.8 | 2.9 | 1.0 |
| 24 | F | 18 | 15 | 1.2 | 90 | 7.4 | 4.3 | 1.7 | 10 | 3.8 | 4.9 | 1.3 |
| 25 | G | 131 | 61 | 2.1 | 94 | 34.0 | 15.0 | 2.3 | 6 | 3.4 | 2.0 | 1.7 |
| 26 | G | 70 | 48 | 1.5 | 94 | 5.9 | 9.9 | 1.7 | 6 | 2.4 | 3.3 | 1.4 |
| 27 | G | 42 | 73 | 1.7 | 94 | 8.5 | 6.3 | 1.3 | 6 | 4.8 | 5.0 | 1.0 |
| 28 | G | 127 | 89 | 1.4 | 92 | 29.0 | 19.0 | 1.5 | 8 | 3.0 | 3.6 | 1.2 |
| 29 | H | 62 | 41 | 1.5 | 19 | 7.9 | 7.4 | 1.1 | 81 | 3.1 | 3.8 | 1.2 |
| 30 | I | 36 | 57 | 1.6 | 98 | 7.4 | 5.2 | 1.4 | 2 | 3.3 | 2.2 | 1.5 |
| 31 | A | 150 | 65 | 2.3 | 96 | 40.0 | 17.5 | 2.3 | 4 | 3.9 | 2.0 | 2.0 |
| 32 | A | 130 | 65 | 2.0 | 96 | 30.0 | 17.0 | 1.8 | 4 | 3.9 | 2.0 | 2.0 |
| 33 | A | 140 | 60 | 2.3 | 90 | 35.0 | 15.5 | 2.3 | 10 | 3.9 | 2.0 | 2.0 |
| 34 | A | 150 | 65 | 2.3 | 15 | 40.0 | 17.5 | 2.3 | 85 | 2.5 | 1.3 | 2.0 |

TABLE 3-continued

| | Characteristics | | | | | | | |
|---|---|---|---|---|---|---|---|---|
| | Tensile Strength | | | Toughness (transition temperature) | | | | |
| Test No. | L MPa | C MPa | \|L − C\| MPa | L ° C. | C ° C. | \|L − C\| ° C. | Shape Evaluation | Remarks |
| 1 | 1045 | 1117 | 72 | −100 | −86 | 14 | 0.032 | Example |
| 2 | 1152 | 1204 | 52 | −134 | −121 | 13 | 0.080 | Example |
| 3 | 1220 | 1205 | 15 | −105 | −94 | 11 | 0.082 | Example |
| 4 | 874 | 977 | 103 | −20 | −50 | 30 | 0.064 | Comparative Example |
| 5 | 1063 | 1161 | 98 | −110 | −100 | 10 | 0.088 | Example |
| 6 | 880 | 992 | 112 | −21 | −59 | 38 | 0.074 | Comparative Example |
| 7 | 791 | 811 | 20 | −98 | −109 | 11 | 0.036 | Comparative Example |
| 8 | 1076 | 1055 | 21 | −49 | −57 | 8 | 0.076 | Comparative Example |
| 9 | 1212 | 1273 | 61 | −63 | −70 | 7 | 0.072 | Example |
| 10 | 1052 | 1099 | 47 | −111 | −112 | 1 | 0.062 | Example |
| 11 | 1001 | 1123 | 122 | −67 | −98 | 31 | 0.064 | Comparative Example |
| 12 | 1179 | 1184 | 5 | −93 | −80 | 13 | 0.052 | Example |
| 13 | 1070 | 1110 | 40 | −70 | −77 | 7 | 0.102 | Example |
| 14 | 911 | 990 | 79 | −107 | −109 | 2 | 0.044 | Comparative Example |
| 15 | 1279 | 1209 | 70 | −98 | −89 | 9 | 0.078 | Example |
| 16 | 1070 | 1048 | 22 | −64 | −77 | 13 | 0.064 | Example |
| 17 | 1262 | 1168 | 94 | −91 | −98 | 7 | 0.072 | Example |
| 18 | 999 | 1032 | 33 | −96 | −110 | 14 | 0.054 | Example |
| 19 | 741 | 824 | 83 | −61 | −114 | 53 | 0.082 | Comparative Example |
| 20 | 1201 | 1213 | 12 | −140 | −131 | 9 | 0.086 | Example |
| 21 | 1111 | 1124 | 13 | −88 | −88 | 0 | 0.081 | Example |
| 22 | 1044 | 1073 | 29 | −91 | −83 | 8 | 0.084 | Example |
| 23 | 1200 | 1186 | 14 | −85 | −100 | 12 | 0.048 | Example |
| 24 | 1024 | 1103 | 79 | −95 | −81 | 14 | 0.078 | Example |
| 25 | 877 | 999 | 122 | −39 | −58 | 19 | 0.036 | Comparative Example |
| 26 | 1067 | 1092 | 25 | −74 | −68 | 6 | 0.078 | Example |
| 27 | 1055 | 1140 | 85 | −66 | −80 | 14 | 0.112 | Example |
| 28 | 846 | 917 | 71 | −37 | −50 | 13 | 0.114 | Comparative Example |
| 29 | 577 | 590 | 13 | −77 | −67 | 10 | 0.135 | Comparative Example |
| 30 | 1016 | 1341 | 325 | −17 | −81 | 64 | 0.082 | Comparative Example |
| 31 | 1000 | 1150 | 150 | −45 | −12 | 33 | 0.130 | Comparative Example |
| 32 | 1000 | 1100 | 100 | −52 | −16 | 36 | 0.130 | Comparative Example |
| 33 | 990 | 1140 | 150 | −43 | −14 | 29 | 0.130 | Comparative Example |
| 34 | 675 | 725 | 50 | −140 | −123 | 17 | 0.130 | Comparative Example |

The underline represents that the underlined value is out of the scope of the present invention.

INDUSTRIAL APPLICABILITY

According to the present invention, it is possible to provide a hot-rolled steel sheet which is excellent in isotropy in tensile strength and toughness and has a tensile strength of 980 MPa or greater. According to the aspects of the present invention, it is possible to manufacture a hot-rolled steel sheet which has a high strength and is excellent in isotropy in tensile strength and toughness without an increase in load on a rolling mill. A hot-rolled steel sheet according to the present invention is suitable as a material for a structural component or a skeleton of a vehicle or a truck frame. By applying the hot-rolled steel sheet according to the present invention to a structural component of a vehicle or the like, it is possible to reduce a vehicle body weight while securing safety of the vehicle, and the environmental load can be reduced. Therefore, the present invention has high industrial applicability.

What is claimed is:

1. A hot-rolled steel sheet comprising, as a chemical composition, by mass %:

C: 0.010% to 0.200%;

Si: 1.00% or less;

Mn: 3.0% or less;

P: 0.040% or less;

S: 0.004% or less;

Al: 0.10% or less;

N: 0.004% or less;

Nb: 0% to 0.20%;

Ti: 0% to 0.15%;

Mo: 0% to 1.00%;

Cu: 0% to 0.50%;

Ni: 0% to 0.50%; and a remainder of Fe and impurities, wherein a metallographic structure includes 90 vol % or greater of martensite and 0 vol % to 10 vol % of a residual structure, the residual structure including one or both of bainite and ferrite, an average prior austenite grain size in an L-section parallel to a rolling direction and an average prior austenite grain size in a C-section parallel to a direction orthogonal to the rolling direction are 1.0 μm to 10.0 μm, an aspect ratio of the prior austenite grain size, which is a ratio of the average prior austenite grain size in the L-section and the average prior austenite grain size in the C-section is, 1.8 or less, an average grain size of the residual structure in the L-section and an average grain size of the residual structure in the C-section are 5.0 μm or less, an aspect ratio of the residual structure, which is a ratio of the average grain size of the residual structure in the L-section and the average grain size of the residual structure in the C-section is, 2.0 or less, in a case where the larger one of the average prior austenite grain size in the L-section and the average prior austenite grain size in the C-section is represented by Dpγ (L) and the smaller one is represented by Dpγ (S), a value obtained by Dpγ (L)/Dpγ (S) is defined as the aspect ratio of the average prior austenite grain size, and in a case where the larger one of the average grain size of the residual structure in the L-section and the average grain size of the residual structure in the C-section is represented by Dr (L) and the smaller one is represented by Dr (S), a value obtained by Dr (L)/Dr (S) is defined as the aspect ratio of the residual structure.

2. The hot-rolled steel sheet according to claim 1, comprising, as the chemical composition, by mass %, one or more of:

Nb: 0.01% to 0.20%;

Ti: 0.01% to 0.15%;

Mo: 0.01% to 1.00%;

Cu: 0.01% to 0.50%; and

Ni: 0.01% to 0.50%.

3. A manufacturing method of a hot-rolled steel sheet according to claim 1, the method comprising:

a hot rolling process in which a steel having the chemical composition according to claim 1 is heated to 1,100° C. to 1,350° C., and then subjected to plural passes of reduction to perform rough rolling and finish rolling, and thus a hot-rolled steel sheet is obtained;

a cooling process in which after completion of the hot rolling process, cooling is started on the hot-rolled steel sheet within 5 seconds and performed to a temperature range of 300° C. or lower at an average cooling rate of 30° C./sec or greater; and a coiling process in which the hot-rolled steel sheet after the cooling process is coiled in the temperature range of 300° C. or lower, wherein the rough rolling is performed under the following condition (I), and the finish rolling is performed under the following condition (II), (I) a temperature T of the steel after a final rolling pass in the rough rolling is in a range of 1,000° C. to 1,300° C., a reduction of the final rolling pass is 105-0.05×T or greater by unit %, and cooling is started within 5 seconds after the steel pass through the final rolling pass and performed to a temperature of $Ar_3$+30° C. to $Ar_3$+300° C. at an average cooling rate of 20° C./sec or greater, (II) a temperature of the steel after a final rolling pass in the finish rolling is $Ar_3$ or higher, and a reduction amount of the final pass in the finish rolling is in a range of 12% to 45%, where the $Ar_3$ is a temperature determined by the following (Formula 1), $$Ar_3(°\,C.)=910-310\times C-80\times Mn-20\times Cu-55\times Ni-80\times Mo \quad \text{(Formula 1)}$$

in the Formula 1, C, Mn, Cu, Ni, and Mo each represent an amount of a corresponding element by mass %, each of which is substituted by zero in a case where the corresponding element is not contained.

4. The manufacturing method of a hot-rolled steel sheet according to claim 3, wherein by the rough rolling, a metallographic structure of the steel sheet before the finish rolling is controlled such that an average austenite grain size in an L-section parallel to a rolling direction of the rough rolling and an average austenite grain size in a C-section parallel to a direction orthogonal to the rolling direction are 100 μm or less, and an aspect ratio of the residual structure, which is a ratio of the average austenite grain size in the L-section and the average austenite grain size in the C-section is, 2.0 or less.

* * * * *